US012239166B2

(12) United States Patent
Boham et al.

(10) Patent No.: US 12,239,166 B2
(45) Date of Patent: Mar. 4, 2025

(54) AEROSOL PROVISION ARTICLE AND SYSTEM

(71) Applicant: Nicoventures Trading Limited, London (GB)

(72) Inventors: Scott George Boham, London (GB); Caner Umit Yurteri, London (GB)

(73) Assignee: Nicoventures Trading Limited, London (GB)

( * ) Notice: Subject to any disclaimer, the term of this patent is extended or adjusted under 35 U.S.C. 154(b) by 46 days.

(21) Appl. No.: 17/767,672

(22) PCT Filed: Sep. 29, 2020

(86) PCT No.: PCT/GB2020/052351
§ 371 (c)(1),
(2) Date: Apr. 8, 2022

(87) PCT Pub. No.: WO2021/069865
PCT Pub. Date: Apr. 15, 2021

(65) Prior Publication Data

US 2023/0413914 A1 Dec. 28, 2023

(30) Foreign Application Priority Data

Oct. 11, 2019 (GB) ..... 1914720

(51) Int. Cl.
*A24F 40/485* (2020.01)
*A24F 40/44* (2020.01)
*A24F 40/46* (2020.01)

(52) U.S. Cl.
CPC ..... *A24F 40/485* (2020.01); *A24F 40/44* (2020.01); *A24F 40/46* (2020.01)

(58) Field of Classification Search
CPC ..... A24F 40/485; A24F 40/46; A24F 40/44
USPC ..... 131/329
See application file for complete search history.

(56) References Cited

U.S. PATENT DOCUMENTS

2016/0007655 A1* 1/2016 Li ..... A24F 40/46 392/390
2017/0273359 A1 9/2017 Liu
2018/0317557 A1 11/2018 Monsees et al.

FOREIGN PATENT DOCUMENTS

EP 2965642 A1 1/2016
WO WO-2016061859 A1 4/2016

OTHER PUBLICATIONS

International Search Report and Written Opinion for Application No. PCT/GB2020/052351, mailed on Jan. 21, 2021, 19 pages.
(Continued)

*Primary Examiner* — Gary F Paumen
(74) *Attorney, Agent, or Firm* — Husch Blackwell

(57) ABSTRACT

An article for use with an aerosol provision system. The article comprises an aerosol-generating chamber including an inlet and an outlet to facilitate air flow through the aerosol-generating chamber, and an aerosol-generating component located in the aerosol-generating chamber such that a variation in air speed proximate to a majority of a surface of the aerosol-generating component is less than 25%.

18 Claims, 10 Drawing Sheets

(56) References Cited

OTHER PUBLICATIONS

Invitation to Pay Additional Fees with Partial International Search for Application No. PCT/GB2020/052351 mailed Nov. 17, 2020, 12 pages.
"International Preliminary Report on Patentability for Application No. PCT/GB2020/052351, mailed on Apr. 21, 2022", 12 pages.

* cited by examiner

| | Date-Time | File | Cv(%) | Dx(10) | Dx(50) | Dx(90) |
|---|---|---|---|---|---|---|
| —— V | 23 Sep 2019-12:13:23.5776 | 2019_09_23_epenillmini o 10 | 0.0008 | 0.20 | 0.48 | 1.18 |
| ---◇--- V | 23 Sep 2019-12:08:54.0896 | 2019_09_23_epenillmini co 1 | 0.0010 | 0.22 | 0.57 | 1.40 |
| --□-- V | 23 Sep 2019-12:09:23.4000 | 2019_09_23_epenillmini co 2 | 0.0006 | 0.22 | 0.51 | 1.11 |
| ---◆--- V | 23 Sep 2019-12:09:53.3352 | 2019_09_23_epenillmini co 3 | 0.0008 | 0.20 | 0.49 | 1.19 |
| —✕— V | 23 Sep 2019-12:10:23.3696 | 2019_09_23_epenillmini co 4 | 0.0007 | 0.23 | 0.63 | 1.60 |
| ---✕--- V | 23 Sep 2019-12:10:53.4040 | 2019_09_23_epenillmini co 5 | 0.0008 | 0.21 | 0.55 | 1.36 |
| —◇— V | 23 Sep 2019-12:11:23.4392 | 2019_09_23_epenillmini co 6 | 0.0007 | 0.20 | 0.50 | 1.27 |
| —□— V | 23 Sep 2019-12:11:53.4736 | 2019_09_23_epenillmini co 7 | 0.0008 | 0.22 | 0.58 | 1.45 |
| —○— V | 23 Sep 2019-12:12:23.5080 | 2019_09_23_epenillmini co 8 | 0.0008 | 0.20 | 0.46 | 1.08 |
| ---✕--- V | 23 Sep 2019-12:12:53.5432 | 2019_09_23_epenillmini co 9 | 0.0007 | 0.21 | 0.51 | 1.22 |

| | Date-Time | File | Cv(%) | Dx(10) | Dx(50) | Dx(90) |
|---|---|---|---|---|---|---|
| —— | 23 Sep 2019-09:34:57.3696 | 2019_09_23_epenillmini o 10 | 0.0007 | 0.21 | 0.54 | 1.35 |
| ···◇·· | 23 Sep 2019-09:30:27.9248 | 2019_09_23_epenillmini op 1 | 0.0009 | 0.23 | 0.46 | 0.91 |
| ··□·· | 23 Sep 2019-09:30:57.2192 | 2019_09_23_epenillmini op 2 | 0.0006 | 0.25 | 0.43 | 0.72 |
| ···◇··· | 23 Sep 2019-09:31:27.1264 | 2019_09_23_epenillmini op 3 | 0.0008 | 0.20 | 0.46 | 1.03 |
| —✳— | 23 Sep 2019-09:31:57.2008 | 2019_09_23_epenillmini op 4 | 0.0007 | 0.22 | 0.51 | 1.15 |
| ···✳·· | 23 Sep 2019-09:32:27.1960 | 2019_09_23_epenillmini op 5 | 0.0007 | 0.20 | 0.43 | 0.91 |
| —○— | 23 Sep 2019-09:32:57.2312 | 2019_09_23_epenillmini op 6 | 0.0007 | 0.21 | 0.57 | 1.46 |
| ···□··· | 23 Sep 2019-09:33:27.2656 | 2019_09_23_epenillmini op 7 | 0.0008 | 0.19 | 0.52 | 1.48 |
| —○— | 23 Sep 2019-09:33:57.3000 | 2019_09_23_epenillmini op 8 | 0.0007 | 0.20 | 0.44 | 0.97 |
| ···✳·· | 23 Sep 2019-09:34:27.3352 | 2019_09_23_epenillmini op 9 | 0.0007 | 0.20 | 0.46 | 1.08 |

| | Date-Time | File | Cv(%) | Dx(10) | Dx(50) | Dx(90) |
|---|---|---|---|---|---|---|
| —— V | 23 Sep 2019-11:00:08.3392 | 2019_09_23_epentilmini o 10 | 0.0008 | 0.20 | 0.44 | 1.01 |
| --◇-- V | 23 Sep 2019-10:55:38.8304 | 2019_09_23_epentilmini op 1 | 0.0010 | 0.21 | 0.45 | 0.96 |
| --□-- V | 23 Sep 2019-10:56:08.2208 | 2019_09_23_epentilmini op 2 | 0.0008 | 0.27 | 0.40 | 0.58 |
| --◇-- V | 23 Sep 2019-10:56:38.1600 | 2019_09_23_epentilmini op 3 | 0.0008 | 0.22 | 0.41 | 0.75 |
| --✕-- V | 23 Sep 2019-10:57:08.1904 | 2019_09_23_epentilmini op 4 | 0.0008 | 0.21 | 0.42 | 0.84 |
| --✳-- V | 23 Sep 2019-10:57:38.2256 | 2019_09_23_epentilmini op 5 | 0.0008 | 0.20 | 0.42 | 0.89 |
| --◇-- V | 23 Sep 2019-10:58:08.2000 | 2019_09_23_epentilmini op 6 | 0.0008 | 0.20 | 0.42 | 0.87 |
| --□-- V | 23 Sep 2019-10:58:38.2352 | 2019_09_23_epentilmini op 7 | 0.0008 | 0.20 | 0.43 | 0.96 |
| --◇-- V | 23 Sep 2019-10:59:08.2696 | 2019_09_23_epentilmini op 8 | 0.0008 | 0.20 | 0.48 | 1.16 |
| --✕-- V | 23 Sep 2019-10:59:38.3048 | 2019_09_23_epentilmini op 9 | 0.0009 | 0.19 | 0.47 | 1.17 |

| | Date-Time | File | Cv(%) | Dx(10) | Dx(50) | Dx(90) |
|---|---|---|---|---|---|---|
| —— | M 23 Sep 2019-10:33:27.7784 | 2019_09_23_epenillimini s 10 | 0.0009 | 0.19 | 0.49 | 1.37 |
| ---○--- | M 23 Sep 2019-10:28:58.4296 | 2019_09_23_epenillimini st 1 | 0.0008 | 0.28 | 0.44 | 0.67 |
| --□-- | M 23 Sep 2019-10:29:27.6088 | 2019_09_23_epenillimini st 2 | 0.0007 | 0.21 | 0.46 | 1.02 |
| ---◇--- | M 23 Sep 2019-10:29:57.6952 | 2019_09_23_epenillimini st 3 | 0.0007 | 0.23 | 0.52 | 1.09 |
| ---✕--- | M 23 Sep 2019-10:30:27.6384 | 2019_09_23_epenillimini st 4 | 0.0007 | 0.22 | 0.43 | 0.85 |
| ---✳--- | M 23 Sep 2019-10:30:57.6048 | 2019_09_23_epenillimini st 5 | 0.0007 | 0.21 | 0.47 | 1.04 |
| ---○--- | M 23 Sep 2019-10:31:27.6392 | 2019_09_23_epenillimini st 6 | 0.0008 | 0.20 | 0.53 | 1.43 |
| ---□--- | M 23 Sep 2019-10:31:57.6744 | 2019_09_23_epenillimini st 7 | 0.0009 | 0.20 | 0.52 | 1.40 |
| ---○--- | M 23 Sep 2019-10:32:27.7088 | 2019_09_23_epenillimini st 8 | 0.0008 | 0.19 | 0.43 | 1.01 |
| ---✕--- | M 23 Sep 2019-10:32:57.7440 | 2019_09_23_epenillimini st 9 | 0.0008 | 0.19 | 0.43 | 0.97 |

| | Date-Time | File | Cv(%) | Dx(10) | Dx(50) | Dx(90) |
|---|---|---|---|---|---|---|
| —— | Vi 23 Sep 2019-15:05:47.0136 | 2019_09_23_epenillmini o 10 | 0.0008 | 0.20 | 0.51 | 1.33 |
| ---○--- | Vi 23 Sep 2019-15:01:17.5456 | 2019_09_23_epenillmini op 1 | 0.0007 | 0.23 | 0.43 | 0.82 |
| --□-- | Vi 23 Sep 2019-15:01:46.8840 | 2019_09_23_epenillmini op 2 | 0.0008 | 0.23 | 0.41 | 0.73 |
| ---◇--- | Vi 23 Sep 2019-15:02:16.8824 | 2019_09_23_epenillmini op 3 | 0.0007 | 0.25 | 0.43 | 0.74 |
| ---✕--- | Vi 23 Sep 2019-15:02:46.8696 | 2019_09_23_epenillmini op 4 | 0.0007 | 0.21 | 0.43 | 0.87 |
| ---✳--- | Vi 23 Sep 2019-15:03:16.8400 | 2019_09_23_epenillmini op 5 | 0.0007 | 0.26 | 0.40 | 0.61 |
| ---○--- | Vi 23 Sep 2019-15:03:47.0032 | 2019_09_23_epenillmini op 6 | 0.0008 | 0.19 | 0.46 | 1.10 |
| ---□--- | Vi 23 Sep 2019-15:04:16.9096 | 2019_09_23_epenillmini op 7 | 0.0007 | 0.20 | 0.42 | 0.88 |
| ---○--- | Vi 23 Sep 2019-15:04:46.9440 | 2019_09_23_epenillmini op 8 | 0.0008 | 0.20 | 0.43 | 0.93 |
| ---✕--- | Vi 23 Sep 2019-15:05:16.9792 | 2019_09_23_epenillmini op 9 | 0.0008 | 0.21 | 0.43 | 0.88 |

AEROSOL PROVISION ARTICLE AND SYSTEM

PRIORITY CLAIM

The present application is a National Phase entry of PCT Application No. PCT/GB2020/052351, filed Sep. 29, 2020, which claims priority from GB Application No. 1914720.6, filed Oct. 11, 2019, each of which is hereby fully incorporated herein by reference.

TECHNICAL FIELD

The present disclosure relates to an article for use with an aerosol provision system and a system comprising the article.

BACKGROUND

Aerosol provision systems which generate an aerosol for inhalation by a user are known in the art. Such systems typically comprise an aerosol provision device and an aerosol generator which is capable of converting an aerosolizable material into an aerosol. In some instances, the aerosol generated is a condensation aerosol whereby an aerosolizable material is heated to form a vapor which is then allowed to condense into an aerosol. In other instances, the aerosol generated is an aerosol which results from the atomization of the aerosolizable material. Such atomization may be brought about mechanically, e.g. by subjecting the aerosolizable material to vibrations so as to form small particles of material that are entrained in airflow. Alternatively, such atomization may be brought about electrostatically, or in other ways, such as by using pressure etc.

Aerosol provision systems, such as e-cigarettes, are generally activated via an activation mechanism on or in the aerosol provision device of the system. Typically, the user will either press a button on a part of the device, or the device (or other part of the system) will include a sensor which determines that aerosol generation should commence, e.g. the device may include an airflow sensor which senses airflow through the device.

It is important to ensure that aerosol provision is in line with the expectations of the user, since if aerosol is not produced in a manner which the user expects, the user may perceive the system to be malfunctioning.

It would thus be desirable to provide an aerosolizable material that is formulated so as to be acceptable to a user.

SUMMARY

In accordance with some embodiments described herein, there is provided an article for use with an aerosol provision system, the article comprising an aerosol-generating chamber including an inlet and an outlet to facilitate air flow through the aerosol-generating chamber, and an aerosol-generating component located in the aerosol-generating chamber such that a variation in air speed proximate to a majority of a surface of the aerosol-generating component is less than 25%.

The inlet may include an elongate slot which is elongate in a first direction. A width of the slot in a second direction perpendicular to the first direction may be less than a width of the aerosol-generating component in the second direction, for example the width of the slot in the second direction may be less than half the width of the aerosol-generating component in the second direction.

The aerosol-generating component may extend in the first direction through a first aperture in a first wall of the aerosol-generating chamber to inside the aerosol-generating chamber and through a second aperture in a second wall of the aerosol-generating chamber, wherein the second wall is opposite the first wall.

A separation between the inlet and the aerosol-generating component may be less than a width of the aerosol-generating component.

The inlet may be configured to direct air towards the aerosol-generating component.

A separation between the outlet and the aerosol-generating component may be less than a width of the aerosol-generating component, for example the separation between the outlet and the aerosol-generating component may be less than half the width of the aerosol-generating component.

The outlet may be a conduit of substantially constant cross-sectional area. A separation between the outlet and the aerosol-generating component may be less than the diameter of the outlet.

The outlet may be configured to draw air from the aerosol-generating chamber.

The aerosol-generating component may include a porous wick with a heater coil arranged in a spiral around the wick.

The majority of the surface of the aerosol-generating component may be at least 80% of an outward facing surface of the aerosol-generating component within the aerosol-generating chamber.

The variation in air speed proximate to the majority of the surface of the aerosol-generating component may be less than 25% at 0.35 mm from the surface of the aerosol-generating component.

The inlet may pass through a wall of the aerosol-generating chamber, and a separation between the inlet and the aerosol-generating component may be less than a separation between the wall of the aerosol-generating chamber and the aerosol-generating component.

In accordance with some embodiments described herein, there is provided an article for use with an aerosol provision system, the article comprising an aerosol-generating chamber including an inlet and an outlet so as to facilitate air flow through the aerosol-generating chamber, and an aerosol-generating component located in the aerosol-generating chamber such that a particle size distribution of an aerosol produced from the article has a D50 of between 0.4 and 0.6 μm.

The particle size distribution of the aerosol produced from the article may have a D90 of less than 1.2 μm. The particle size distribution of the aerosol produced from the article may have a D10 of between 0.2 and 0.25 μm.

In accordance with some embodiments described herein, there is provided an aerosol provision system including an article as described herein.

In accordance with some embodiments described herein, there is provided an aerosol provision system, the system comprising:

- an aerosol-generating chamber including an inlet and an outlet to facilitate air flow through the aerosol-generating chamber; and
- an aerosol-generating component located in the aerosol-generating chamber such that a variation in air speed proximate to a majority of a surface of the aerosol-generating component is less than 25%.

Thus, it will be appreciated that the combination of aerosol-generating chamber and aerosol-generating component described herein need not be limited to being located in an article for use with an aerosol provision system, but may form part of an aerosol provision system or component thereof, such as an aerosol delivery device.

The article can be used with an aerosol provision device so as to form an aerosol provision system. The aerosol provision device typically comprises a power source and a controller. In some instances, the aerosol provision device will contain the aerosol-generating component. During operation of the aerosol provision device, the controller can determine that a user has initiated a request for the generation of an aerosol. This could be done via a button on the device which sends a signal to the controller that the aerosol generator should be powered. Alternatively, a sensor located in or proximal to the airflow pathway could detect airflow through the airflow pathway and convey this detection to the controller. A sensor may also be present in addition to the presence of a button, as the sensor may be used to determine certain usage characteristics, such as airflow, timing of aerosol generation etc.

These aspects and other aspects will be apparent from the following detailed description. In this regard, particular sections of the description are not to be read in isolation from other sections.

BRIEF DESCRIPTION OF THE DRAWINGS

Embodiments of the disclosure will now be described, by way of example only, with reference to accompanying drawings, in which.

DETAILED DESCRIPTION OF THE DRAWINGS

Aspects and features of certain examples and embodiments are discussed/described herein. Some aspects and features of certain examples and embodiments may be implemented conventionally and these are not discussed/described in detail in the interests of brevity. It will thus be appreciated that aspects and features of articles and systems discussed herein which are not described in detail may be implemented in accordance with any conventional techniques for implementing such aspects and features.

As described above, the present disclosure relates to (but it not limited to) articles for use with aerosol provision systems, such as e-cigarettes and electronic cigarettes.

Figure 1:
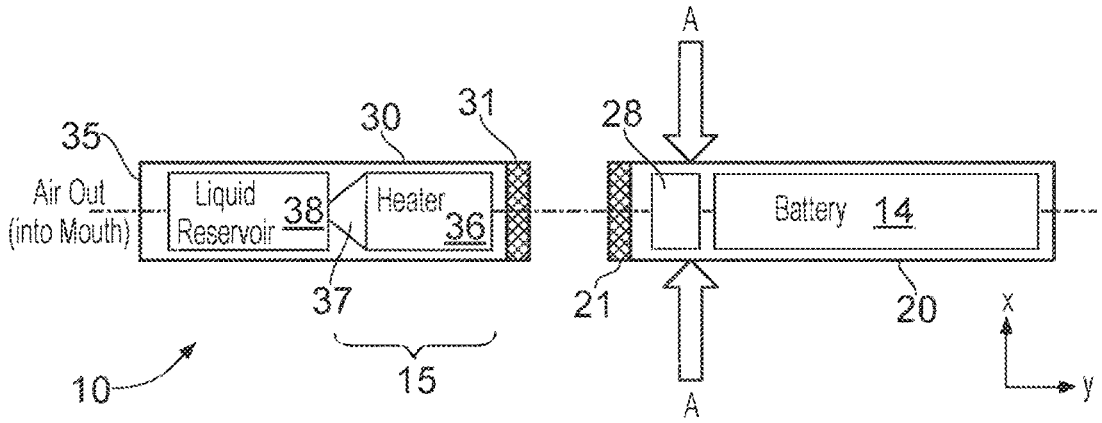
FIG. 1 is a schematic diagram of an aerosol provision system.

FIG. 1 is a highly schematic diagram (not to scale) of an example aerosol provision system 10, such as an e-cigarette, to which embodiments are applicable. The e-cigarette has a generally cylindrical shape, extending along a longitudinal or y-axis as indicated by a dashed line (although aspects of the disclosure are applicable to e-cigarettes configured in other shapes and arrangements), and comprises two main components, namely an aerosol provision device 20 and an article 30.

The article 30 includes a store for aerosolizable material (source liquid) 38 containing an aerosolizable material (source liquid) from which an aerosol is to be generated. The article 30 generally comprises a heating element or heater 36 for heating aerosolizable material to generate an aerosol. A wicking element or component or wick 37 is provided to deliver aerosolizable material from the store 38 to the heating element 36. A part or parts of the wick 37 are in fluid communication with aerosolizable material in the store 38 and by a wicking or capillary action aerosolizable material is drawn along or through the wick 37 to a part or parts of the wick 37 which are in contact with the heater 36. It should be noted that it is possible for the heating element or heater 36 to be part of the aerosol provision device 20 and the article then may comprise the store for aerosolizable material, such that when the article is coupled with the aerosol provision device aerosolizable material can be transferred to the heating element or heater 36.

Vaporization of the aerosolizable material occurs at the interface between the wick 37 and the heater 36 by the provision of heat energy to the aerosolizable material to cause evaporation, thus generating the aerosol. The aerosolizable material, the wick 37 and the heater 36 may be collectively referred to as an aerosol or vapor source.

The wick 37 and the heater 36 may be collectively referred to as an aerosol-generating component 15.

For ease of reference, the x and y-axes are marked in FIG. 1. The x-axis will be referred to herein as the width of the device (from side to side), while the y axis y-axis will be referred to herein as the height axis. A z-axis (not shown in FIG. 1) is perpendicular to the x and y axes shown in FIG. 1. The z-axis will be referred to herein as the depth axis. Although the example aerosol provision system 10 illustrated in FIG. 1 has a generally cylindrical shape, other embodiments of aerosol provision system 10 may have a depth of in the z-axis which is less that width in the x-axis, for example if the aerosol provision system 10 is an oval or elliptical cross-section in the x-z plane.

The article 30 and the aerosol provision device 20 are detachable from one another by separating in a direction parallel to the y-axis, but are joined together when the aerosol provision system 10 is in use so as to provide mechanical and electrical connectivity between the article 30 and the aerosol provision device 20. When the aerosolizable material in the store 38 has been depleted, the article 30 is removed and a new article is attached to the aerosol provision device 20. Accordingly, the article 30 may sometimes be referred to as the disposable portion of the e-cigarette 10, while the aerosol provision device 20 represents the re-usable portion.

FIGS. 2 to 6 and 12 each illustrate a cross section through an article 30 for use with an aerosol provision system, such as the aerosol provision system 10 as described above. The cross section in each of FIGS. 2 to 6 and 12 is taken through the y-axis as illustrated in FIG. 1, and for ease of reference, the corresponding x and y axes are shown in each of FIGS. 2 to 6.

In each of the embodiments illustrated in FIGS. 2 to 6 and 12, the article 30 comprises an aerosol-generating chamber 40 and an aerosol-generating component 15 located in the aerosol-generating chamber 40.

The aerosol-generating chamber 40 has an inlet 50 and an outlet 60 to facilitate air flow through the aerosol-generating chamber 40. In other words, air is able to enter the aerosol-generating chamber 40 through the inlet 50, flow around the aerosol-generating component 15 and exit the aerosol-generating chamber 40 through the outlet 60. Although not illustrated in FIG. 2, the inlet 50 may be connected to an opening on the side of the article or at another location on the aerosol provision system 10, such as indicated by the A arrows in FIG. 1, in order to facilitate air flow into the aerosol-generating chamber 40 from outside the aerosol provision system 10. The outlet 60 may be connected to another opening on the article 10, such as a mouthpiece as indicated by the 'Air Out' label in FIG. 1, in order to facilitate airflow out of the aerosol-generating chamber 40 and into the mouth of a user. Accordingly, when a user draws on the aerosol provision system 10, air is drawn out of the aerosol-generating chamber 40 through the outlet 60 and is replace by air entering the aerosol-generating chamber 40 through the inlet 50.

In some embodiments the aerosol-generating component 15 extends in a first direction through a first aperture in a first wall of the aerosol-generating chamber 40 to inside the aerosol-generating chamber 40 and through a second aperture in a second wall of the aerosol-generating chamber 40, wherein the second wall is opposite the first wall. In other words, a portion of the aerosol-generating component 15 is located within the aerosol-generating chamber 40, with two further portions of the aerosol-generating component 15 located on each side of the aerosol-generating chamber 40. In the embodiments illustrated in FIGS. 2 to 6, the first direction corresponds to the z-axis perpendicular to both the x and y-axes shown in the figures. The majority of the aerosol-generating component 15 may be located inside the aerosol-generating chamber 40, for example more than 50, 75, 80 or 95% of the volume of the aerosol-generating component 15 being located inside the aerosol-generating chamber 40.

The aerosol-generating component 15 has a width 150 in a second direction, corresponding to the x-axis shown in the figures. In the illustrated embodiments where aerosol-generating component 15 has a circular cross section, this width 150 corresponds to the diameter of the aerosol-generating component 15. The width 150 of the aerosol-generating component 15 may be between 1 and 5 mm, for example between 2 and 4 mm, for example between 2 and 2.5 mm, for example 2.1 mm. It will be appreciated, however, that a circular cross section is not essential, and the width of the aerosol-generating component 15 may refer more generally to the largest dimension of the aerosol-generating component 15 in the second direction, corresponding to the x-axis shown in the figures. For example, the aerosol-generating component 15 may have an elliptical, oval or other shape cross-section. In the case of an oval or elliptical shaped cross-section, the width of the aerosol-generating component 15 may correspond to the major axis or the minor axis depending on the orientation of the oval or ellipse.

The aerosol-generating chamber 40 has a first side wall 42 and a second side wall 44, where the second side wall 44 is opposite the first side wall 42 in the direction corresponding to the x direction. The aerosol-generating component 15 may be located in the aerosol-generating chamber 40 such that a distance between the aerosol-generating component 150 and the first side wall 42 is substantially the same or less than the width 15 of the aerosol-generating component 15. Equally, a distance between the aerosol-generating component 15 and the second side wall 44 may be substantially the same or less than the width 150 of the aerosol-generating component 15. The distance between the first side wall 42 and the aerosol-generating component 150 may be the same as the distance between the second side wall 44 and the aerosol-generating component 150 (as is the case when the aerosol-generating component 150 is located centrally within the aerosol-generating chamber 40 in the direction corresponding to the x axis x axis.)

Figure 2:
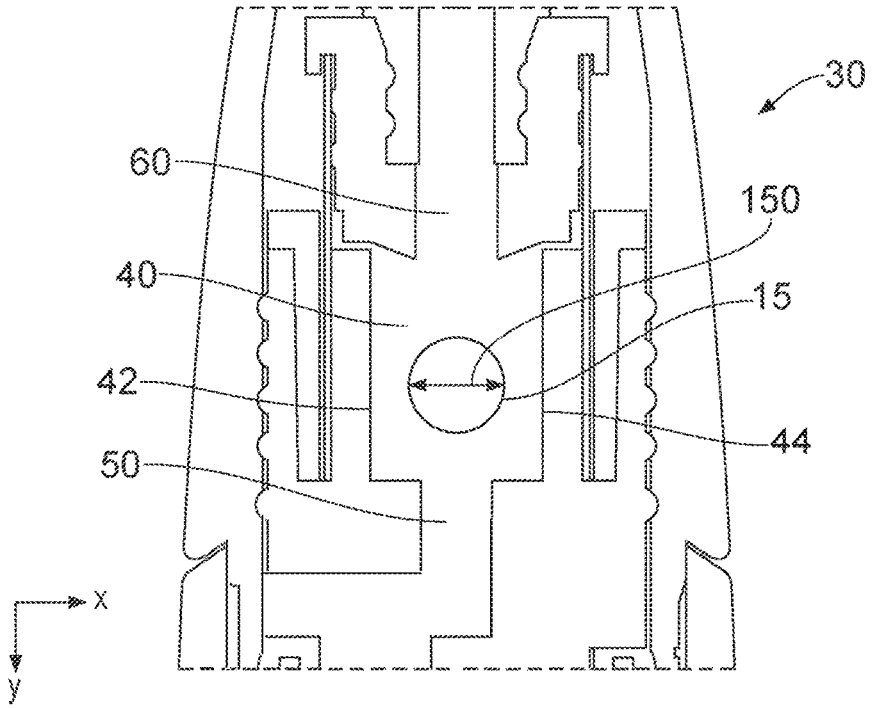
FIGS. 2 to 6 each illustrate a cross section through an article for use with an aerosol provision system.
Figure 4:
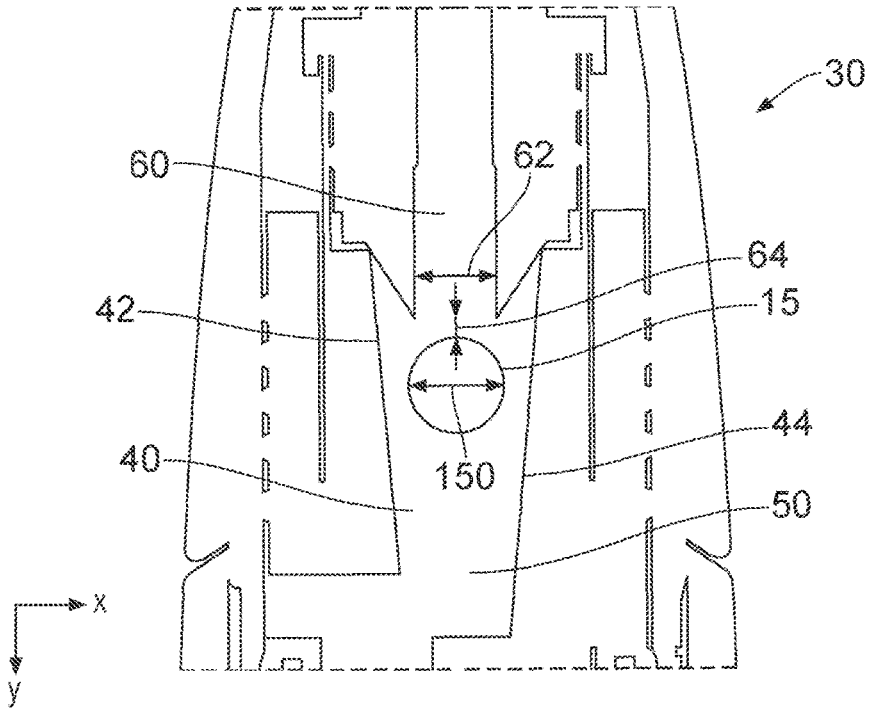

As illustrated in FIG. 2, the first side wall 42 and the second side wall 44 may be planar in the longitudinal y-axis, but this is not essential. FIG. 4 illustrates an alternative arrangement where the first side wall 42 and the second side wall 44 are not planar in the longitudinal y-axis.

The aerosol-generating component 15 can include a porous wick with a heater coil arranged in a spiral around the wick. It will be appreciated that the wick and heater may be in an alternative arrangement whilst still providing an interface between the wick and heater in order for vaporization of the aerosolizable material to occur. Further, an alternative configuration of aerosol-generating component 15 may be used in place of a porous wick and a heater coil. In some embodiments, the aerosol-generating component 15 is capable of generating an aerosol from the aerosolizable material without heating. For example, the aerosol-generating component 15 may be capable of generating an aerosol from the aerosolizable material without applying heat thereto, for example via one or more of vibrational, mechanical, pressurization or electrostatic means. The shape of the aerosol-generating component 15 may also be dependent on the means by which the aerosol-generating component 15 generates an aerosol. For example, the aerosol-generating component 15 may be in the form of a flat plate. Equally, an aerosol-generating component 15 including a porous wick with a heater coil arranged in a spiral around the wick does not form the shape of an exact cylinder As it will be appreciated, the air speed within the aerosol-generating chamber 40 will be different at different locations within the aerosol-generating chamber 40. The aerosol-generating component 15 is located in the aerosol-generating chamber 40 such that a variation in air speed proximate to a majority of a surface of the aerosol-generating component 15 is less than 25%. In other words, the positioning of the aerosol-generating component 15 within the aerosol-generating chamber 40 ensures that the variation in air speed proximate to a majority of a surface of the aerosol-generating component 15 is less than 25%. For example, if the mean air speed around the aerosol-generating component 15 is 3.0 m/s, the lowest air speed proximate to the surface of the aerosol-generating component 15 is 2.25 m/s and the highest air speed proximate to the surface of the aerosol-generating component 15 is 3.75 m/s.

As illustrated in FIGS. 2 to 6 and 12, the inlet 50 and the outlet 60 are located at opposite sides of the aerosol-generating chamber 40 in a direction along the longitudinal y-axis. The aerosol-generating component 15 is then located in the aerosol-generating chamber 40 between the inlet 50 and the outlet 60, thereby acting as an obstruction to the flow through the aerosol-generating chamber 40. Air flowing through the aerosol-generating chamber 40 therefore passes around the aerosol-generating component 15 in order to flow from the inlet 50 to the outlet 60.

In some embodiments, the majority of a surface of the aerosol-generating component 15 corresponds to at least 80% of an outward facing surface of the aerosol-generating component 15 within the aerosol-generating chamber 40. As described above, at least a portion of the aerosol-generating component 15 may not be located within the aerosol-generating chamber 40, and therefore such a portion will not be provided with air flow. Accordingly, the surface of the aerosol-generating component 15 is limited to the portion of the surface of the aerosol-generating component 15 which is located within the aerosol-generating component. The outward surface is understood to mean the one or more surfaces of the aerosol-generating chamber 40 around which the air flows. In other words, the outward facing surface of the aerosol-generating chamber 40 corresponds to the wetted area or the perimeter surface of the aerosol-generating chamber 40.

In the situation described above where at least a portion of the aerosol-generating component 15 is not located within the aerosol-generating chamber 40, the aerosol-generating component 15 extends in the first direction through a first aperture in a first wall of the aerosol-generating chamber 40 to inside the aerosol-generating chamber 40 and through a second aperture in a second wall of the aerosol-generating chamber 40. It will be appreciated that the air speed proximate to the surface of the aerosol-generating chamber 40 will be affected by the presence of the first wall and the second wall, and therefore the variation in air flow and air speed proximate to the surface of the aerosol-generating component 40 will be greater at the portions of the aerosol-generating component 40 proximate to the first wall and the second wall. Accordingly, the variation in air speed proximate to the surface of the aerosol-generating component 15 may only be less than 25% for the portion of the aerosol-generating component 15 located a sufficient distance from the first wall and the second wall. In other words, the majority of the surface of the aerosol-generating component is at least 80% of an outward facing surface of the aerosol-generating component 15 within the aerosol-generating chamber 40. This at least 80% of the outward facing surface of the aerosol-generating component 15 may correspond to the portion of the aerosol-generating component 15 locating centrally in the aerosol-generating chamber 40 between the first wall and the second wall, where the remaining less than 20% of the outward facing surface of the aerosol-generating component 15 corresponds to 10% of the outward facing surface of the aerosol-generating component 15 proximate to the first wall and 10% of the outward facing surface of the aerosol-generating component 15 proximate to the second wall.

As it will be appreciated, air speed decreases as the distance to a surface reduces such that the air speed at a surface is zero. Accordingly, the air speed proximate to a surface of the aerosol-generated component 15 may be understood to mean the free stream speed over the surface of the aerosol-generated component 15, in other words the air speed at the edge of the boundary layer of the surface of the aerosol-generated component 15. Equally, the air speed proximate to a surface of the aerosol-generated component 15 may be understood to mean the air speed within a defined distance of the surface of the aerosol-generated component 15, for example between 0.1 and 1 mm of the surface of the aerosol-generated component 15, more specific between 0.1 and 0.5 mm of the surface, more specific between 0.2 and 0.4 mm of the surface. In some embodiments, the variation in air speed proximate to the majority of the surface of the aerosol-generating component 15 is less than 25% at 0.35 mm from the surface of the aerosol-generating component 15. For example, if the mean air speed at a distance of 0.35 mm from the surface of the aerosol-generating component 15 is 3.0 m/s, the lowest air speed at a distance of 0.35 mm from the surface of the aerosol-generating component 15 is 2.25 m/s and the highest air speed at a distance of 0.35 mm from the surface of the aerosol-generating component 15 is 3.75 m/s and this holds true across at least 80% of the outward facing surface of the aerosol-generating component.

As illustrated in FIGS. 2 to 6 and 12, the aerosol-generating component 15 may be located substantially in the center of the aerosol-generating chamber 40, and each of the inlet 50, the aerosol-generating component 15 and the outlet 60 may be aligned along the y-axis at the same position on the x-axis such that air flowing out of the inlet is directed towards the center or middle of the aerosol-generating component 15.

Further, each of the inlet 50, the aerosol-generating component 15 and the outlet 60 may have a common line of symmetry corresponding to a centerline through the aerosol-generating chamber 40 along the longitudinal y-axis such that the variation in air flow and air speed on either side of the aerosol-generating component 15 in a direction corresponding to the x-axis is substantially the same. As will be described in more detail below, the variation in air flow and air speed on either side of the aerosol-generating component 15 in a direction corresponding to the y-axis can then be controlled based on the location of the aerosol-generating component 15 relative to both the inlet 50 and the outlet 60. In other words, the variation in air flow and air speed upstream of the aerosol-generating component 15 (i.e. between the inlet 40 and aerosol-generating component 15) can be controlled by the relative locations and geometries of the inlet 50 and the aerosol-generating component 15 whilst the variation in air flow and air speed downstream of the aerosol-generating component 15 (i.e. between the aerosol-generating component 15 and the outlet 60) can be controlled by the relative locations and geometries of the aerosol-generating component 15 and the outlet 60.

Figure 3:
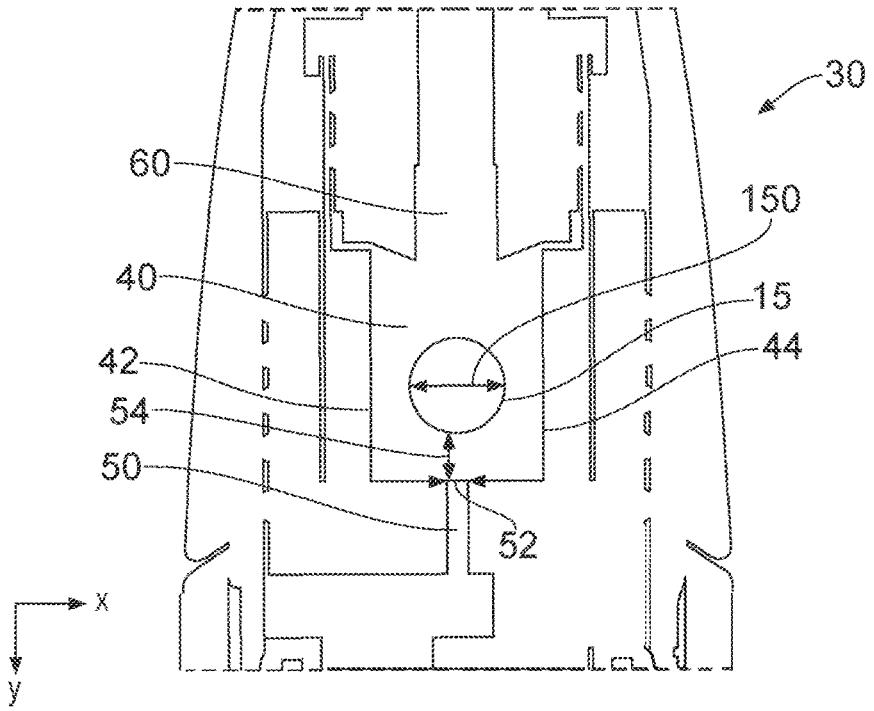

In the embodiment illustrated in FIG. 3, the inlet 50 includes an elongate slot. The elongate slot is elongate in a first direction, for example along a z-axis perpendicular to both the x and y-axes shown in the figures. The elongate slot has a width 52 in a second direction which is perpendicular to the first direction. In the embodiment illustrated in FIG. 3, the second direction is along the x-axis shown in the figures. In other words, the inlet 50 is an elongate opening or aperture in a wall of the aerosol-generating chamber 40 which has a dimension or length in a first direction which is substantially larger than a dimension or width 52 in a second direction perpendicular to the first direction.

The elongate slot may be rectangular in cross section, or any other suitable elongate shape, such as an oval or an ellipse, where the major axis corresponds to the first direction and the minor axis corresponds to the second direction. In particular, an elongate slot with an elliptical cross section provides the improved particular size distribution as described below, with reference to FIGS. 7 to 11.

The inlet 50 passes through a wall 46 of the aerosol-generating chamber 40. As illustrated in FIGS. 2, 3, 5 and 12, the edge between the inlet 50 and the wall 46 of the aerosol-generating chamber 40 through which the inlet 50 passes is sharp. In other words, the radius of curvature between the wall of the aerosol-generating chamber 40 and the inlet 50 is substantially zero. This directs the air flowing out of the inlet towards the aerosol-generating component 15 and reduces the amount of air which is directed to the sides of the aerosol-generating chamber or otherwise away from the aerosol-generating component 15.

In some embodiments, such as where the aerosol-generating component 15 includes a porous wick with a heater coil, the aerosol-generating component 15 may also be elongate in the same direction such that the slot is configured to direct air towards the aerosol-generating component 15 along a majority of the length of the aerosol-generating component 15 located within the aerosol-generating chamber 40 in the first direction. As described above, the aerosol-generating component 15 may be arranged such that it extends through an aperture in a first wall of the aerosol-generating chamber 40 to inside the aerosol-generating chamber 40 and through an aperture in a second wall of the aerosol-generating chamber 40. In this case, the length of the slot may correspond to the majority or substantially all of the distance between the first wall and the second wall in the first direction, for example 50, 60, 70, 80, 90 or 95% of the distance between the first wall and the second wall in the first direction. For example, the elongate slot may be elliptical in cross section and extend 50% of the distance between the first wall and the second wall in the first direction, or the elongate slot may be rectangular in cross section and extend 95% of the of the distance between the first wall and the second wall in the first direction. This then results in the inlet being arranged to direct air towards the aerosol-generating component 15 along a majority or substantially all of the length of the aerosol-generating component 15 that is located within the aerosol-generating chamber 40 in the first direction. In other words, the majority or substantially all of the length of the aerosol-generating component 15 that is located between the first wall and the second wall of the aerosol-generating chamber 40.

In some embodiments, the center of the elongate slot in the first direction is positioned equidistant between the first wall and the second wall in the first direction (the z-axis perpendicular to both the x and y-axes shown in the figures). In other words, where the elongate slot does not extend all of the distance between the first wall and the second wall in the first direction, the distance between the first wall and an edge or side of the elongate slot in the first direction is the same as the distance between the second wall and an edge or side of the elongate slot in the first direction.

In the embodiment illustrated in FIG. 3, the width 52 of the slot in the second direction corresponding to the x-axis is less than the width 150 of the aerosol-generating component 15 in the second direction. In some embodiments, the width of the slot in the second direction corresponding to the x-axis is less than half the width 150 of the aerosol-generating component 15 in the second direction, for example less than a quarter of the width 150 of the aerosol-generating component 52 in the second direction. The width of the slot, however, has an impact of the draw strength required by the user when puffing on the aerosol provision system 10, and therefore the size of the slot (the width and the length of the slot) must be sufficient to allow an acceptable draw strength requirement for the aerosol provision system 10.

In the embodiment illustrated in FIG. 3, the separation 54 between the inlet 50 and the aerosol-generating component 15 is less than a width 150 of the aerosol-generating component 15. In other words, the distance between the inlet 50 and the aerosol-generating component 15 in the longitudinal direction is less than the width of the aerosol-generating component 15 in the direction corresponding to the x-axis.

The separation 54 between the inlet 50 and the aerosol-generating component 15 may be the same as one or both of the distance between the first side wall 42 and the aerosol-generating component 15 and the distance between the second side wall 44 and the aerosol-generating component 15.

In the embodiment illustrated in FIG. 12, a modified version of the inlet configuration described above in relation to FIG. 3 is combined with the outlet configuration described below in relation to FIG. 4. It will be appreciated that any of the inlet configurations described herein may be used in combination with any of the outlet configurations described herein such that the pressure gradients upstream and downstream of the aerosol-generating component 15 are altered in order to reduce the variation in air speed proximate to aerosol-generating component 15.

Figure 12:
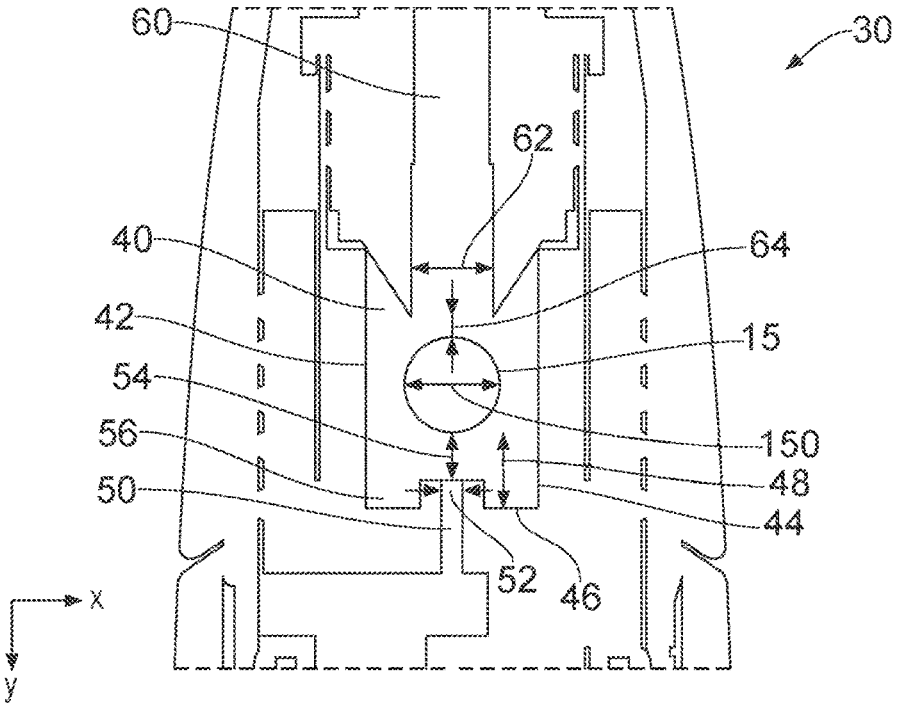
FIG. 12 illustrates a cross section through an article for use with an aerosol provision system.

In the embodiment illustrated in FIG. 12, the inlet 50 protrudes or otherwise extends into the aerosol-generating chamber 40. In other words, the inlet 50 is closer to the aerosol-generating component 15 than the wall 46 through which the inlet 50 passes. As described above, the inlet 50 passes through a wall 46 of the aerosol-generating chamber. Due to the protrusion of the inlet 50, the separation 54 between the inlet 50 and the aerosol-generating component 15 is less than the separation 48 between the wall 46 of the aerosol-generating chamber 40 and the aerosol-generating component 15. For example, the separation 54 between the inlet 50 and the aerosol-generating component 15 may be 25%, 50% or 75% of the separation 48 between the wall 46 of the aerosol-generating chamber 40 and the aerosol-generating component 15. This difference in separation between the wall 46 of the aerosol-generating chamber 40, the inlet 50 and the aerosol-generating component 15 creates a reservoir 56 adjacent to the side wall 46 through which the inlet passes and surrounding the inlet 50. This reservoir 56 impedes or prevents liquid, for example from the aerosol-generating component 15, from entering the air channel 50. It will be appreciated that liquid from the aerosol-generating component 15 in the embodiment illustrated in FIG. 3 may collect on the side wall through which the inlet 50 passes and flow into the inlet 50. Such liquid entering the air channel could block or otherwise disrupt the air flow through the inlet and into the aerosol-generating chamber 40, for example affecting the air flow and the pressure drop. In the embodiment illustrated in FIG. 12 liquid that collects on the side wall 46 through which the inlet 50 passes is unable to flow into the inlet 50.

The separation 54 between the inlet 50 and the aerosol-generating component 15 is the same for the embodiments illustrated in FIGS. 3 and 12. In other words, the extension of the inlet 50 into the aerosol-generating chamber 40 and away from the side wall 46 is achieved by moving the side wall 46 away from the aerosol-generating component 15 rather than increasing the length of the inlet 50. For example, during manufacture, material can be removed from component forming the aerosol-generating chamber 40 in order to move the side wall from the location illustrated in FIG. 3 to the location illustrated in FIG. 12.

In each of the inlet 50 configurations and arrangements described above, the variation in air speed proximate to aerosol-generating component 15 is reduced by altering the pressure gradient upstream of the aerosol-generating component 15. In other words, the proximity of the inlet 50 to the aerosol-generating component 15 and the relative dimensions of the inlet 60 and aerosol-generating component 15 changes the pressure gradient between the inlet 50 and the aerosol-generating component 15.

In the embodiment illustrated in FIG. 4, the outlet 60 is arranged with the aerosol-generating component 15 such that the separation 64 between the outlet 60 and the aerosol-generating component 15 is less than the width of the generating aerosol-generating component 15, for example less than half the width of the aerosol-generating component 15. In other words, the distance between the outlet 50 and the aerosol-generating component 15 in the longitudinal direction is less than the width of the aerosol-generating component 15 in the direction corresponding to the x-axis. Alternatively, the separation between the outlet 60 and the aerosol-generating component 15 may be defined as the shortest distance between the outlet 60 and the aerosol-generating component 15, which as illustrated in FIG. 4 may not correspond to the separation in the longitudinal (y-axis) direction.

The outlet 60 has a width 62 in the second direction corresponding to the x axis x axis. In some embodiments, the outlet 60 is circular in cross section, and the width 62 of the outlet 60 corresponds to the diameter of the circular cross section. As illustrated in FIG. 4, the width 64 of the outlet 60 may be less than the width 150 of the aerosol-generating component 15. In some embodiments, the width 64 of the outlet 60 is greater than half the width 150 of the aerosol-generating component 15 but less than the width 150 of the aerosol-generating component 15. For example, the width 64 of the outlet 60 may be between 60% and 95% of the width 150 of the aerosol-generating component 50, such as between 75% and 95% of the width 150 of the aerosol-generating component 50.

In some embodiments the separation between the outlet 60 and the aerosol-generating component 15 is less than the width 64 of the outlet 60, for example less than half the diameter of the outlet.

In each of the outlet 60 configurations and arrangements described above, the variation in air speed proximate to aerosol-generating component 15 is reduced by altering the pressure gradient downstream of the aerosol-generating component 15. In other words, the proximity of the outlet 60 to the aerosol-generating component 15 and the relative dimensions of the outlet 60 and aerosol-generating component 15 changes the pressure gradient between the aerosol-generating component 15 and the outlet 60. This reduces flow separation on the downstream side of the aerosol-generating component 15 and allows the air flow to remain attached to a greater proportion of the downstream side of the aerosol-generating component 15. This reduces the variation in air speed proximate to aerosol-generating component 15 since the air flow speed on the downstream side of the aerosol-generating component 15 is more uniform.

Figure 5:
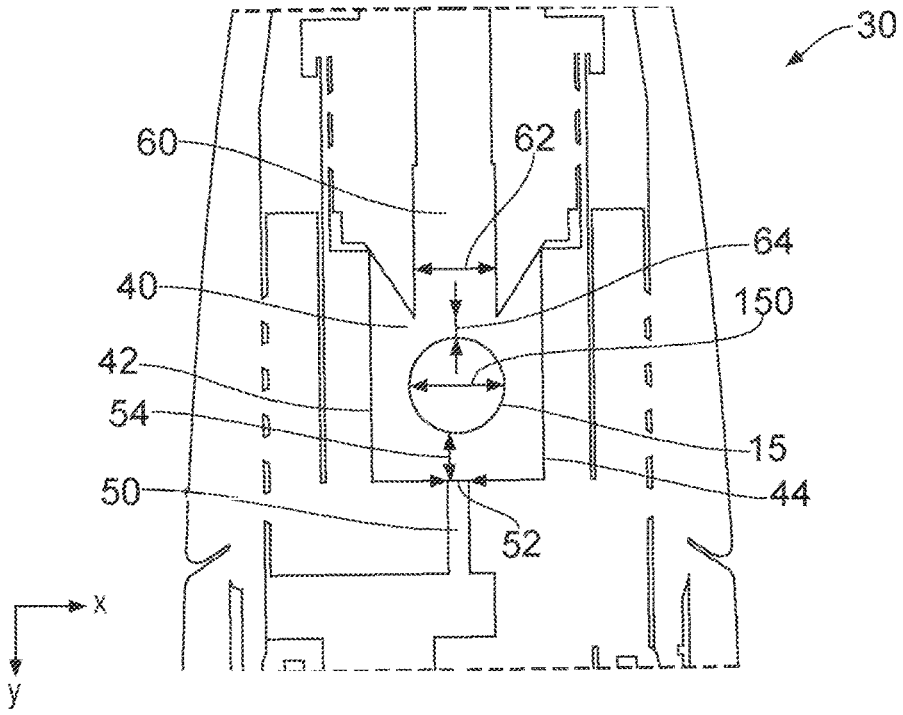

In the embodiment illustrated in FIG. 5, the inlet configuration described above in relation to FIG. 3 is combined with the outlet configuration described above in relation to FIG. 4. It will be appreciated that any of the inlet configurations described herein may be used in combination with any of the outlet configurations described herein such that the pressure gradients upstream and downstream of the aerosol-generating component 15 are altered in order to reduce the variation in air speed proximate to aerosol-generating component 15.

Figure 6:
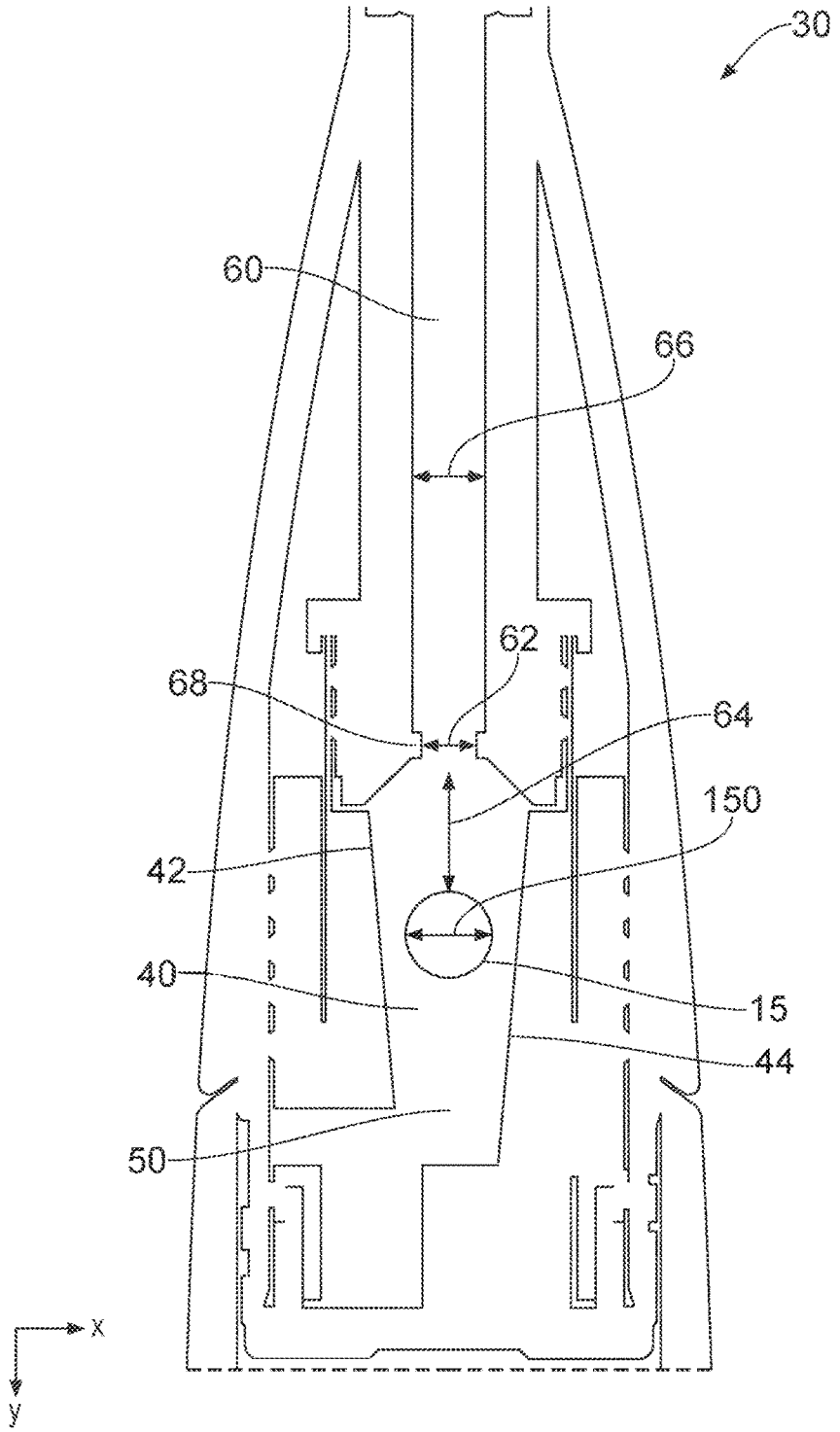

FIG. 6 illustrates a further embodiment of outlet configuration, where the outlet is a conduit of substantially constant cross sectional area. In other words, the outlet extends in the longitudinal (y-axis) direction, and the cross sectional shape and area of the outlet in the longitudinal (y-axis) direction remains substantially the same and constant. For example, the outlet 60 may have a circular cross section such that the diameter 66 of the conduit is substantially constant in the longitudinal (y-axis) direction.

As illustrated in FIG. 6, the width 62 of the outlet 60 proximate to the aerosol-generating chamber 40 and the aerosol-generating component 15 may be less than the width 66 of the outlet 60 in the remaining portion of the outlet corresponding to the conduit section. In other words, the outlet 60 comprises a restriction 68 at the portion of the outlet proximate to the aerosol-generating chamber 40 and the aerosol-generating component 15 where air flows into the outlet 60. The cross sectional area of the restriction 68 is less than the cross sectional area of the portion of the outlet 60 downstream of the restriction 68. The conduit may be considered the portion of the outlet 60 downstream of the restriction 68 such that the portion of the outlet downstream of the restriction 68 has substantially constant cross sectional area.

The embodiments described above in relation to FIGS. 2 to 6 all relate to geometries and arrangements of aerosol-generating chamber 40, aerosol-generating component 15, inlet 50 and outlet 60 in order to provide a variation in air speed proximate to a majority of a surface of the aerosol-generating component of less than 25%.

Example

A SprayTec machine was setup to deliver a puff of 55 ml over a duration of 3 seconds, repeated every 30 seconds (also referred to as a 55/3/30 puff regime). This regime was repeated 10 times for each sample such that 10 puffs were records per sample. The particle size for each puff was overlaid onto one graph and the D10, D50 and D90 values recorded, where it will be appreciated that D10, D50 and D90 represent the intercepts for 10%, 50% and 90% of the cumulative mass of the particle size. 5 different articles were tested, each with a different arrangement of aerosol-generating chamber 40, inlet 50 and outlet 60.

The control sample corresponds to the aerosol-generating chamber 40 and inlet 50 geometries illustrated in FIG. 4, but with an outlet 60 geometry corresponding to that in FIG. 63. Samples corresponding to each of the geometries illustrated in FIGS. 4, 5 and 6 were tested. The final sample corresponded to geometry illustrated in FIG. 5, but combined with the outlet conduit of substantially constant cross-sectional area as described in relation to FIG. 6.

Figure 7:
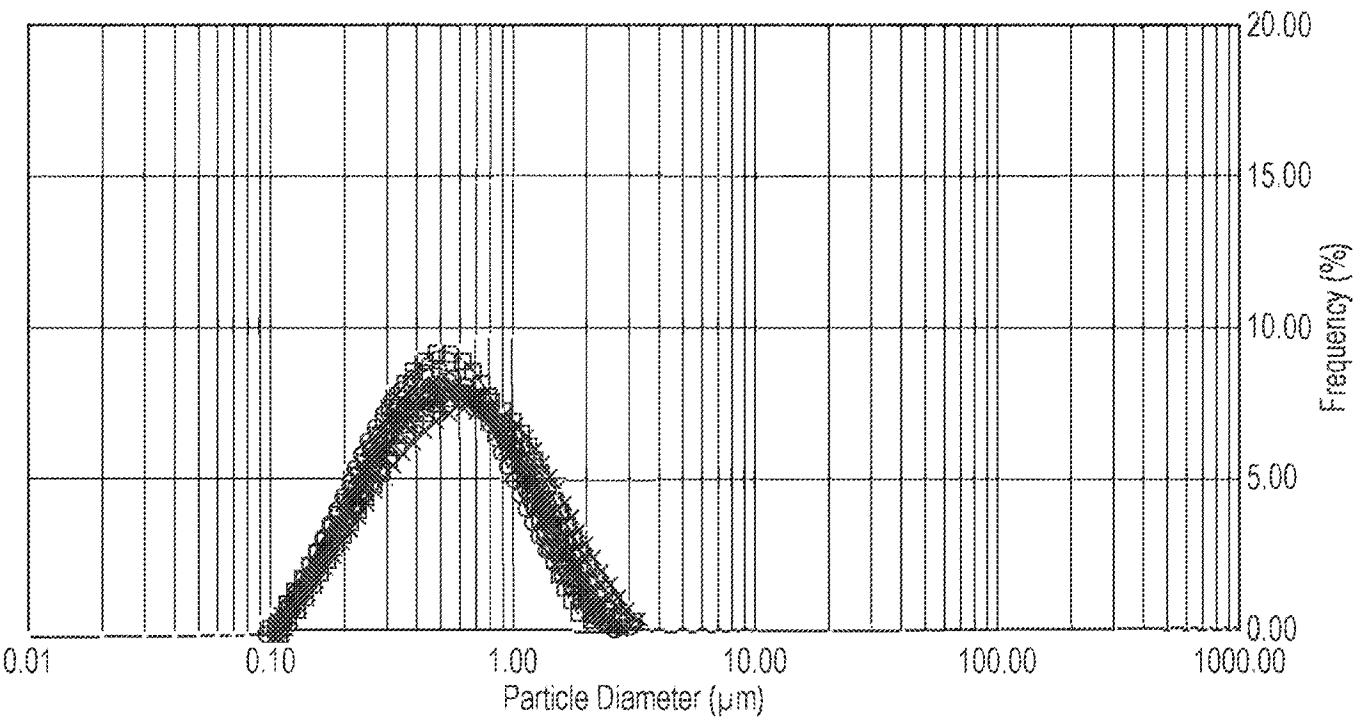
FIGS. 7 to 11 are frequency vs. particular size graphs for samples tested through a 55/3/30 puff regime.
Figure 8:
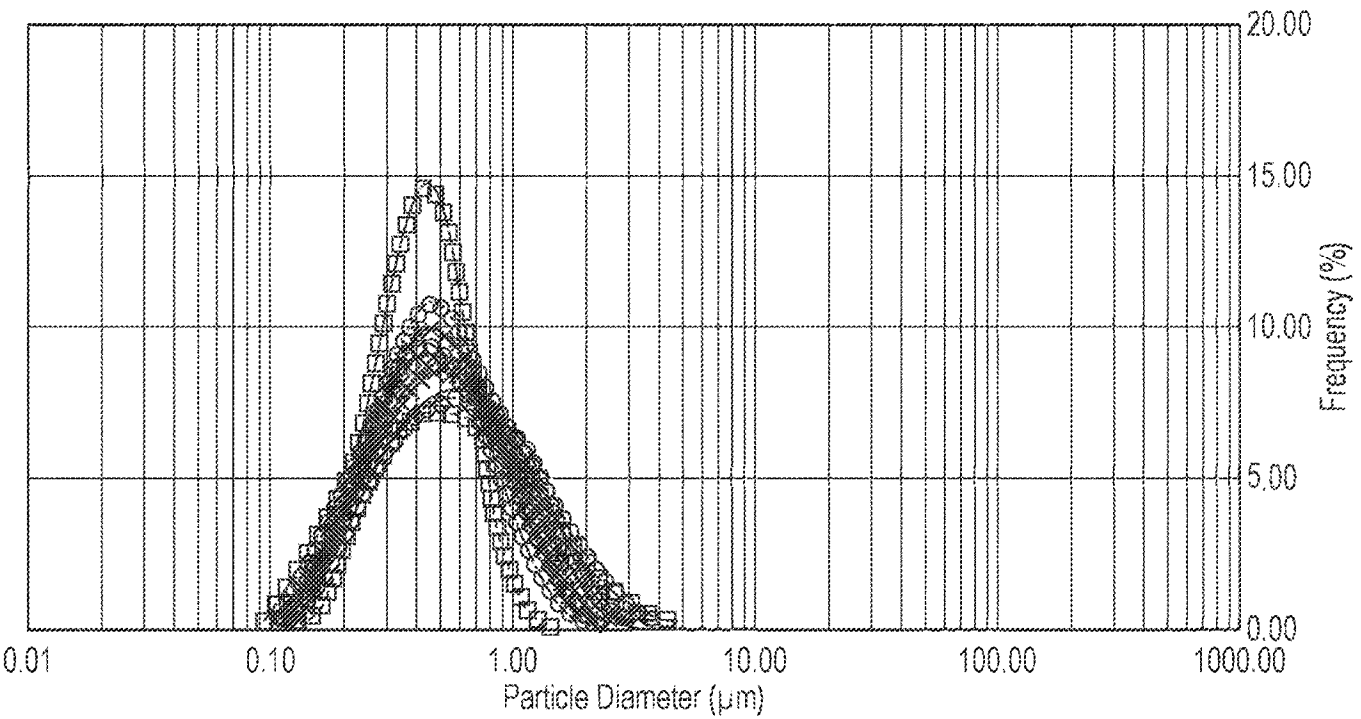
Figure 9:
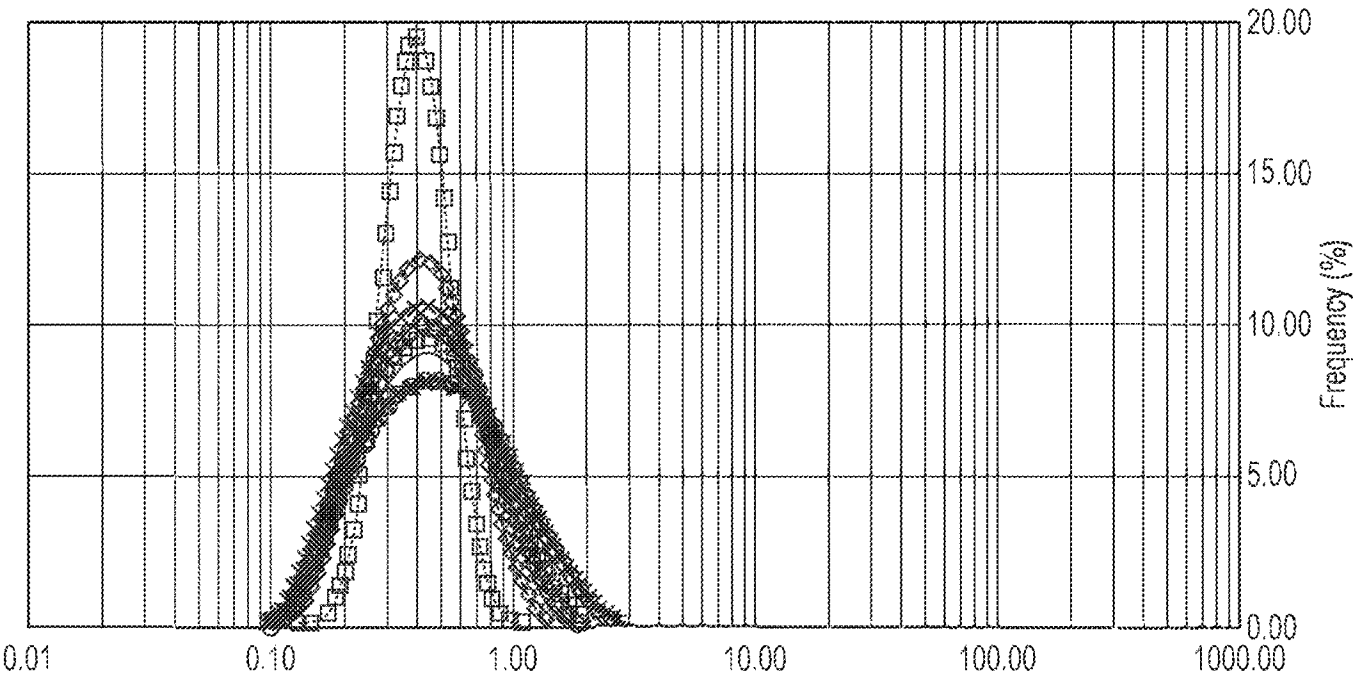
Figure 10:
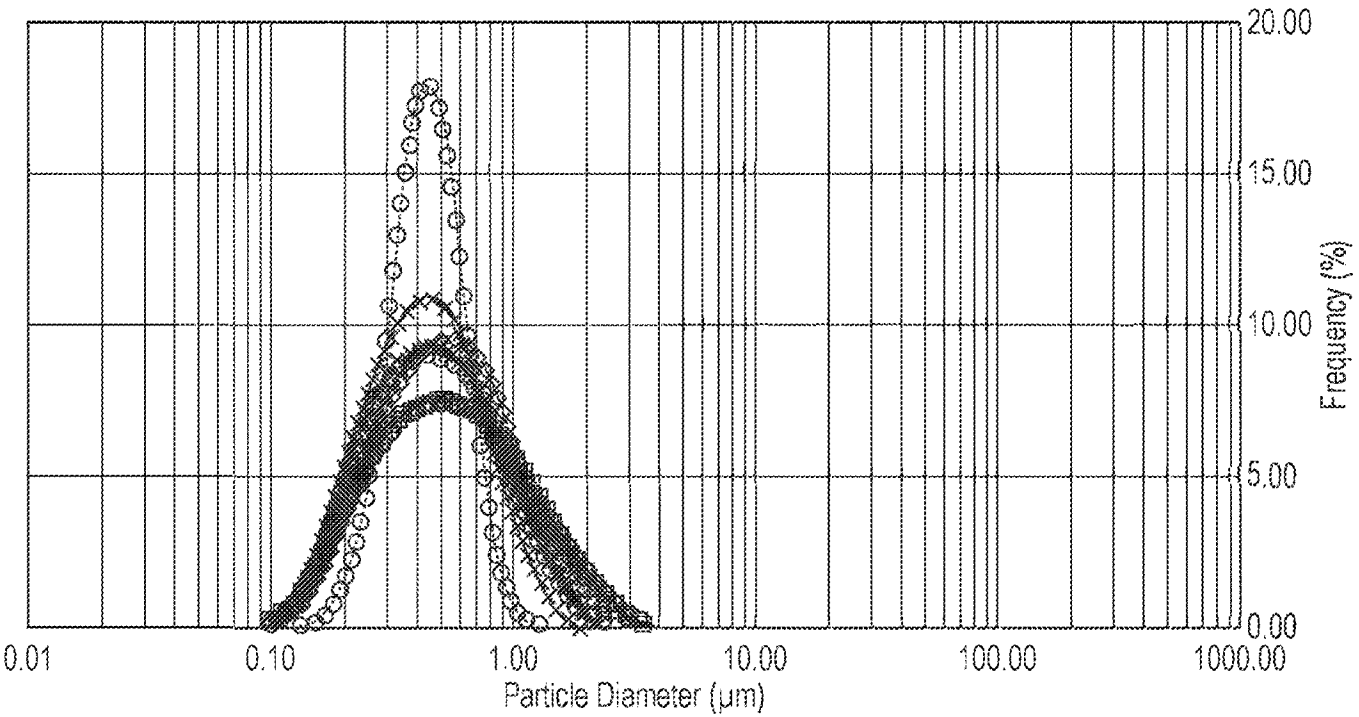
Figure 11:
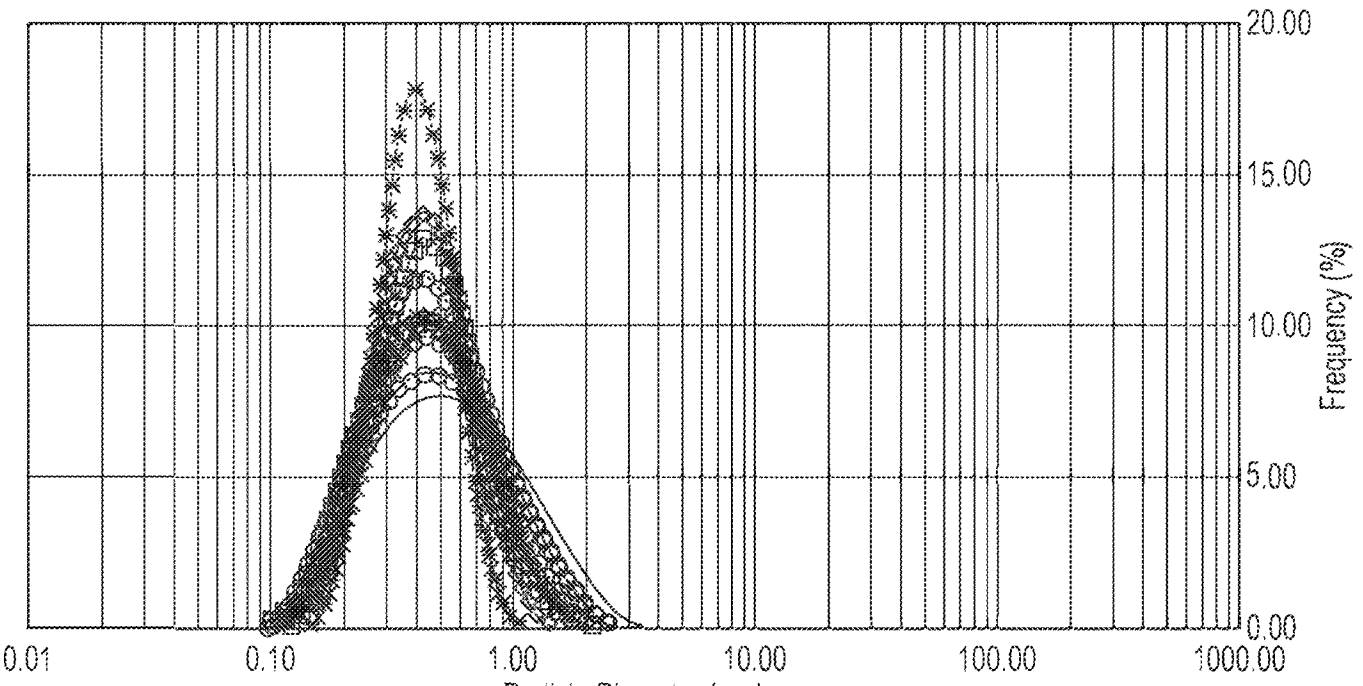

FIGS. 7 to 11 show graphs of frequency vs. particle diameter for the samples tested, where FIG. 7 corresponds to the control sample, FIG. 8 corresponds to the FIG. 4 geometry, FIG. 9 corresponds to the FIG. 5 geometry, FIG. 10 corresponds to the FIG. 6 geometry and FIG. 11 corresponds to the sample with the FIG. 5 geometry with the outlet conduit of substantially constant cross-sectional area.

Table 1 below summarizes the D10, D50 and D90 values for each of the test samples, whilst Table 2 below summaries the time to aerosol formation and the time to max density of aerosol for each of the samples tested.

TABLE 1

| Sample | D10 (μm) | D50 (μm) | D90 (μm) |
|---|---|---|---|
| Control | 0.21 | 0.52 | 1.28 |
| FIG. 4 | 0.21 | 0.48 | 1.10 |
| FIG. 5 | 0.21 | 0.43 | 0.91 |
| FIG. 6 | 0.21 | 0.47 | 1.08 |
| FIG. 5 inlet, FIG. 6 outlet conduit | 0.21 | 0.43 | 0.88 |

TABLE 2

| Sample | Time to Aerosol Formation (s) | Time to Max Density of Aerosol (s) |
|---|---|---|
| Control | 0.8 | 2.0 |
| FIG. 4 | 0.8 | 2.1 |
| FIG. 5 | 0.8 | 2.1 |
| FIG. 6 | 0.9 | 2.0 |
| FIG. 5 inlet, FIG. 6 outlet conduit | 0.8 | 1.6 |

As the results in table 1 show, the various geometries of aerosol-generating chamber 40, inlet 50 and outlet 60 described above reduce the D50 and D90 particular sizes compared to the control sample geometry without changing the D10 particular sizes. In other words, the D10 particle sizes for the various geometries of aerosol-generating chamber 40, inlet 50 and outlet 60 described above is between 0.2 and 0.25 μm, more specifically in between 0.2 and 0.22 μm.

The D50 particle sizes for the various geometries of aerosol-generating chamber 40, inlet 50 and outlet 60 described above is between 0.4 and 0.6 μm Further, the various geometries of aerosol-generating chamber 40, inlet 50 and outlet 60 described above reduce the D50 particle size to less than 0.5 μm, such that the D50 particle size is between 0.4 and 0.5 μm.

The various geometries of aerosol-generating chamber 40, inlet 50 and outlet 60 described above reduce the D90 particle size to less than 1.2 μm. Each of the FIG. 5, FIG. 6 and FIG. 5 geometry with an outlet conduit of substantially constant cross-sectional area geometries reduce the D90 particle size to below 1.1 μm, the FIG. 5 and FIG. 5 geometry with an outlet conduit of substantially constant cross-sectional area geometries reduce the D90 particle size to below 1 μm and the FIG. 5 geometry with an outlet conduit of substantially constant cross-sectional area reduces the D90 particle size to below 0.9 μm.

The results in table 2 show that the various geometries of aerosol-generating chamber 40, inlet 50 and outlet 60 described above do not substantially change the time to aerosol formation compared to the control sample geometry, whilst the time to max density of aerosol does not substantially change with the geometries shown in FIG. 4, FIG. 5 and FIG. 6. The combination of the FIG. 5 geometry with an outlet conduit of substantially constant cross-sectional area does, however, reduce the time to max density of aerosol from around 2 seconds to 1.6 seconds.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure, and that other embodiments may be utilized and modifications may be made without departing from the scope of the disclosure. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An article for use with an aerosol provision system, the article comprising:

an aerosol-generating chamber including an inlet and an outlet to facilitate air flow through the aerosol-generating chamber, wherein the inlet includes an elongate slot which is elongate in a first direction; and an aerosol-generating component located in the aerosol-generating chamber, wherein the aerosol generating component extends in the first direction and a separation between the inlet and the aerosol generating component is less than a width of the aerosol generating component such that a variation in air speed proximate to a majority of a surface of the aerosol-generating component is less than 25%.

2. The article of claim 1, wherein a width of the slot in a second direction perpendicular to the first direction is less than a width of the aerosol-generating component in the second direction.

3. The article of claim 2, wherein the width of the slot in the second direction is less than half the width of the aerosol-generating component in the second direction.

4. The article of claim 1, wherein the inlet is configured to direct air towards the aerosol-generating component.

5. The article of claim 1, wherein a separation between the outlet and the aerosol-generating component is less than a width of the aerosol-generating component.

6. The article of claim 5, wherein the separation between the outlet and the aerosol-generating component is less than half the width of the aerosol-generating component.

7. The article of claim 1, wherein the outlet is a conduit of substantially constant cross-sectional area.

8. The article of claim 7, wherein a separation between the outlet and the aerosol-generating component is less than the diameter of the outlet.

9. The article of claim 1, wherein the outlet is configured to draw air from the aerosol-generating chamber.

10. The article of claim 1, wherein the aerosol-generating component includes a porous wick with a heater coil arranged in a spiral around the wick.

11. The article of claim 1, wherein a majority of a surface of the aerosol-generating component is at least 80% of an outward facing surface of the aerosol-generating component within the aerosol-generating chamber.

12. The article of claim 1, wherein the variation in air speed proximate to a majority of a surface of the aerosol-generating component is less than 25% at 0.35 mm from the surface of the aerosol-generating component.

13. The article of claim 1, wherein the inlet passes through a wall of the aerosol-generating chamber, and a separation between the inlet and the aerosol-generating component is less than a separation between the wall of the aerosol-generating chamber and the aerosol-generating component.

14. An article for use with an aerosol provision system, the article comprising:

an aerosol-generating chamber including an inlet and an outlet so as to facilitate air flow through the aerosol-generating chamber, wherein the inlet includes an elongate slot which is elongated in a first direction; and an aerosol-generating component located in the aerosol-generating chamber, wherein the aerosol generating component extends in the first direction and a separation between the inlet and the aerosol generating component is less than a width of the aerosol generating component such that a particle size distribution of an aerosol produced from the article has a D50 of between 0.4 and 0.6 μm.

15. The article of claim 14, wherein the particle size distribution of the aerosol produced from the article has a D90 of less than 1.2 μm.

16. The article of claim 14, wherein the particle size distribution of the aerosol produced from the article has a D10 of between 0.2 and 0.25 μm.

17. An aerosol provision system, the system comprising:

an aerosol-generating chamber including an inlet and an outlet to facilitate air flow through the aerosol-generating chamber, wherein the inlet includes an elongate slot which is elongate in a first direction; and an aerosol-generating component located in the aerosol-generating chamber, wherein the aerosol generating component extends in the first direction and a separation between the inlet and the aerosol generating component is less than a width of the aerosol generating component such that a variation in air speed proximate to a majority of a surface of the aerosol-generating component is less than 25%.

18. The aerosol provision system according to claim 17, wherein the aerosol-generating chamber and aerosol-generating component form part of an aerosol delivery device for use with an article.

* * * * *